US009335685B2

(12) United States Patent
Takeuchi

(10) Patent No.: US 9,335,685 B2
(45) Date of Patent: May 10, 2016

(54) FIXING DEVICE AND IMAGE FORMING APPARATUS

(71) Applicant: KYOCERA Document Solutions Inc., Osaka (JP)

(72) Inventor: Toshimitsu Takeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/507,876

(22) Filed: Oct. 7, 2014

(65) Prior Publication Data

US 2015/0110532 A1 Apr. 23, 2015

(30) Foreign Application Priority Data

Oct. 17, 2013 (JP) ..... 2013-216561

(51) Int. Cl.
*G03G 15/20* (2006.01)

(52) U.S. Cl.
CPC ..... *G03G 15/2053* (2013.01); *G03G 15/2032* (2013.01)

(58) Field of Classification Search
USPC ..... 399/329
See application file for complete search history.

(56) References Cited

U.S. PATENT DOCUMENTS 8,588,670 B2 11/2013 Shimokawa et al.
2015/0078793 A1* 3/2015 Takahashi et al. ..... 399/329

FOREIGN PATENT DOCUMENTS

JP 2006-113179 A 4/2006
JP 2011-237495 A 11/2011

* cited by examiner

*Primary Examiner* — Minh Phan
(74) *Attorney, Agent, or Firm* — Studebaker & Brackett PC

(57) ABSTRACT

A fixing device includes a fixing member, a pressuring member, a heat source, a heat conducting member, a reflecting member and a contacting/separating mechanism. The fixing member is arranged rotatably. The pressuring member is arranged at an external diameter side of the fixing member to come into pressure contact with the fixing member so as to form a fixing nip, and arranged rotatably. The heat source is arranged at an internal diameter side of the fixing member to emit radiant heat. The heat conducting member comes into contact with an inner circumference face of the fixing member to absorb the radiant heat emitted from the heat source and to conduct it to the fixing member. The reflecting member reflects the radiant heat emitted from the heat source toward the heat conducting member. The contacting/separating mechanism makes the heat conducting member and reflecting member come into contact with/separate from each other.

8 Claims, 10 Drawing Sheets

FIXING DEVICE AND IMAGE FORMING APPARATUS

INCORPORATION BY REFERENCE

This application is based on and claims the benefit of priority from Japanese Patent application No. 2013-216561 filed on Oct. 17, 2013, the entire contents of which are incorporated herein by reference.

BACKGROUND

The present disclosure relates to a fixing device fixing a toner image onto a recording medium and an image forming apparatus including the fixing device.

Conventionally, an electrographic image forming apparatus, such as a copying machine, a printer, a facsimile or alternatively a multifunction peripheral having functionally these, includes a fixing device fixing a toner image onto a recording medium. The fixing device includes a fixing member (e.g. a fixing roller or a fixing belt) and a pressuring member (e.g. a pressuring roller or a pressuring belt) and, between the fixing member and pressuring member, a fixing nip is formed. When the recording medium is passed though the fixing nip in a condition where the fixing member is heated by a heat source, such as a halogen heater, a toner image formed on a surface of the recording medium is heated and melted, and then, the toner image is fixed onto the recording medium.

Conventionally, in such a fixing device, the fixing member is composed of the fixing roller. However, recently, in viewpoints of energy saving and shortening of a warm-up time and a first print time, instead of the fixing roller, the fixing member is often composed of a thin member having a small heat capacity as the fixing belt.

In such a fixing device, when the fixing member having the small heat capacity is directly heated by the heat source, a problem of locally heating the fixing member to bring temperature non-uniformity onto the fixing member and to deform the fixing member is caused.

Thereupon, there is a configuration of heating a heat conducting member by radiant heat emitted from the heat source and heating the fixing member by heat conduction from the heat conducting member. In such a conventional technique, the radiant heat emitted from the heat source is reflected by a reflecting member toward the heat conducting member.

In the conventional technique as mentioned above, there is a case where both end parts of the heat conducting member are fixed to both end parts of the reflecting member. In this case, the heat conducting member and reflecting member always come into contact with each other. Because of this, when the fixing member is heated by the heat conduction from the heat conducting member, not only heat transfer from the heat conducting member to the fixing member, but also heat transfer from the heat conducting member to the reflecting member is caused, and then, it is difficult to efficiently heat the fixing member.

Moreover, in the conventional technique as mentioned above, there is a case where the heat conducting member and reflecting member are connected via a reinforcement member. In this case, if uniformity of the temperature of the fixing member is desired, since it is impossible to efficiently transfer the heat of the fixing member to the reflecting member via the heat conducting member, a time required for uniformizing the temperature of the fixing member is elongated.

SUMMARY

In accordance with an embodiment of the present disclosure, a fixing device includes a fixing member, a pressuring member, a heat source, a heat conducting member, a reflecting member and a contacting/separating mechanism. The fixing member is arranged rotatably. The pressuring member is arranged at an external diameter side of the fixing member to come into pressure contact with the fixing member so as to form a fixing nip, and arranged rotatably. The heat source is arranged at an internal diameter side of the fixing member to emit radiant heat. The heat conducting member comes into contact with an inner circumference face of the fixing member to absorb the radiant heat emitted from the heat source and to conduct it to the fixing member. The reflecting member reflects the radiant heat emitted from the heat source toward the heat conducting member. The contacting/separating mechanism makes the heat conducting member and reflecting member come into contact with/separate from each other.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
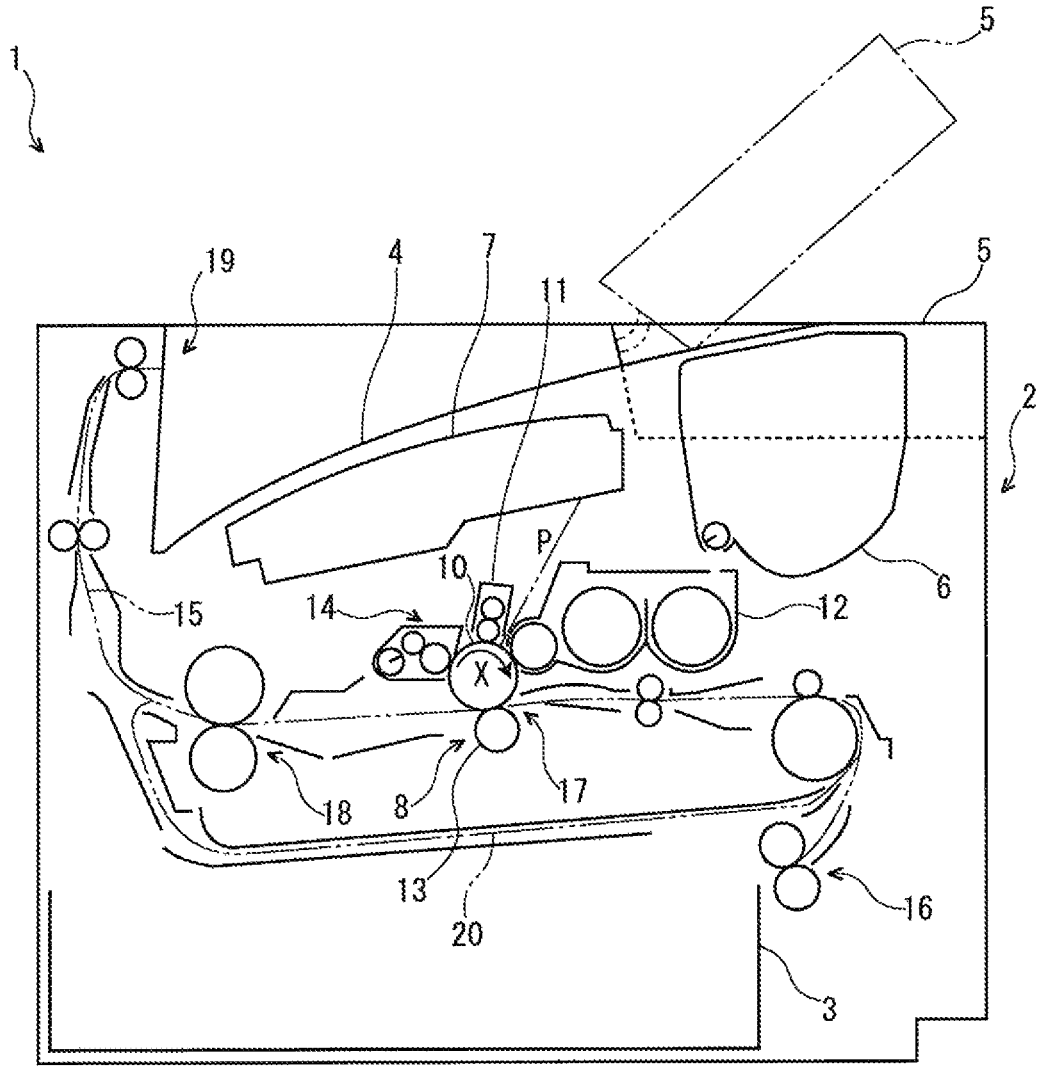
FIG. 1 is a schematic diagram schematically showing a printer according to a first embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeder 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet fed from the sheet feeding cartridge 3 by the sheet feeder 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, the fixing device 18 will be described in detail. Hereinafter, it will be described so that the front side of the fixing device 18 is positioned at the near side on FIGS. 2 and 3, for convenience of explanation. Arrows Y in FIGS. 2 and 3 indicate a conveying direction of the sheet. Arrows Fr in FIGS. 4A and 4B indicate the front side of the fixing device 18.

Figure 2:
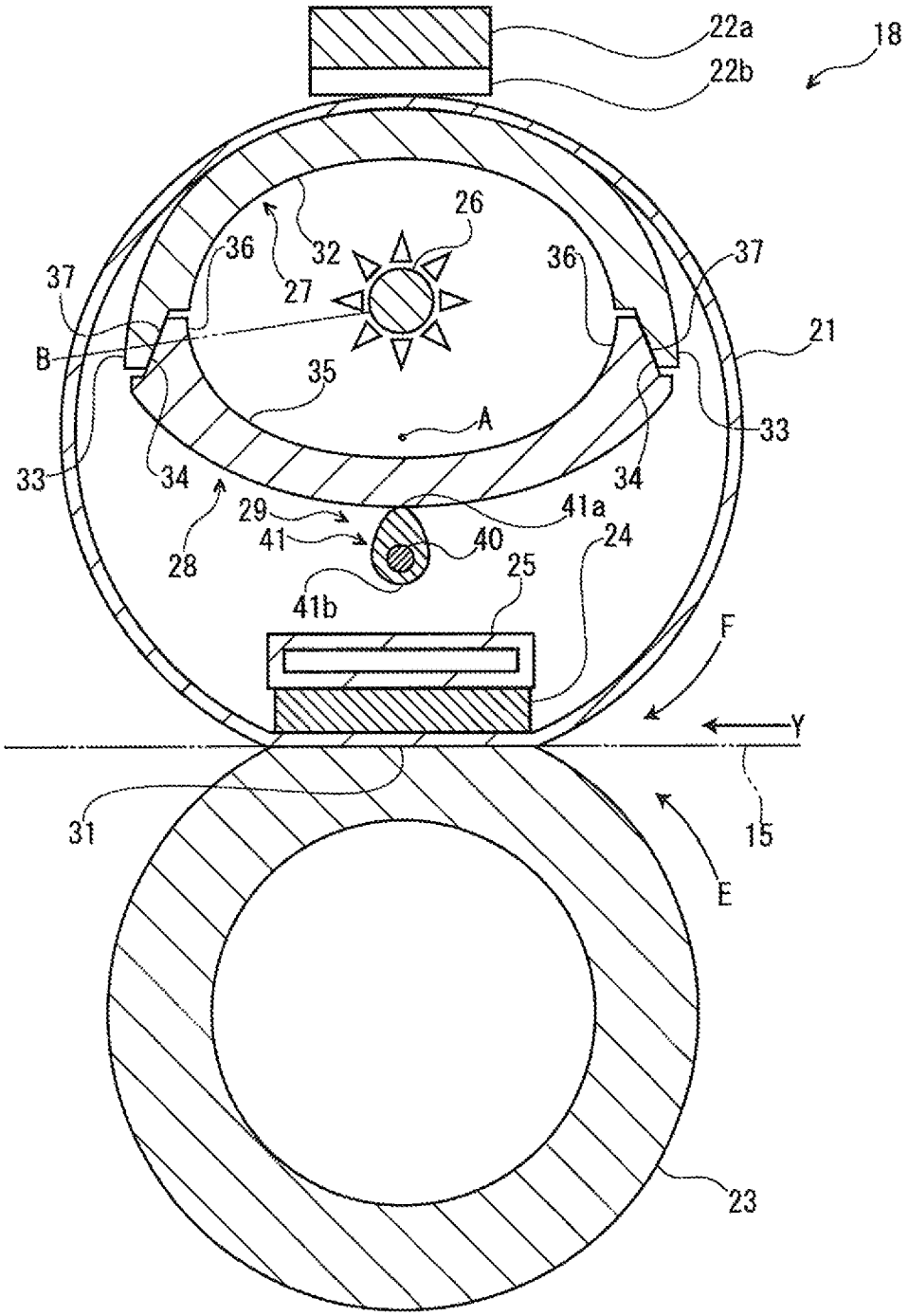
FIG. 2 is a sectional view showing a fixing device, in a condition where a first contacting part of a heat conducting member and a second contacting part of a reflecting member come into contact with each other, according to the first embodiment of the present disclosure.
Figure 3:
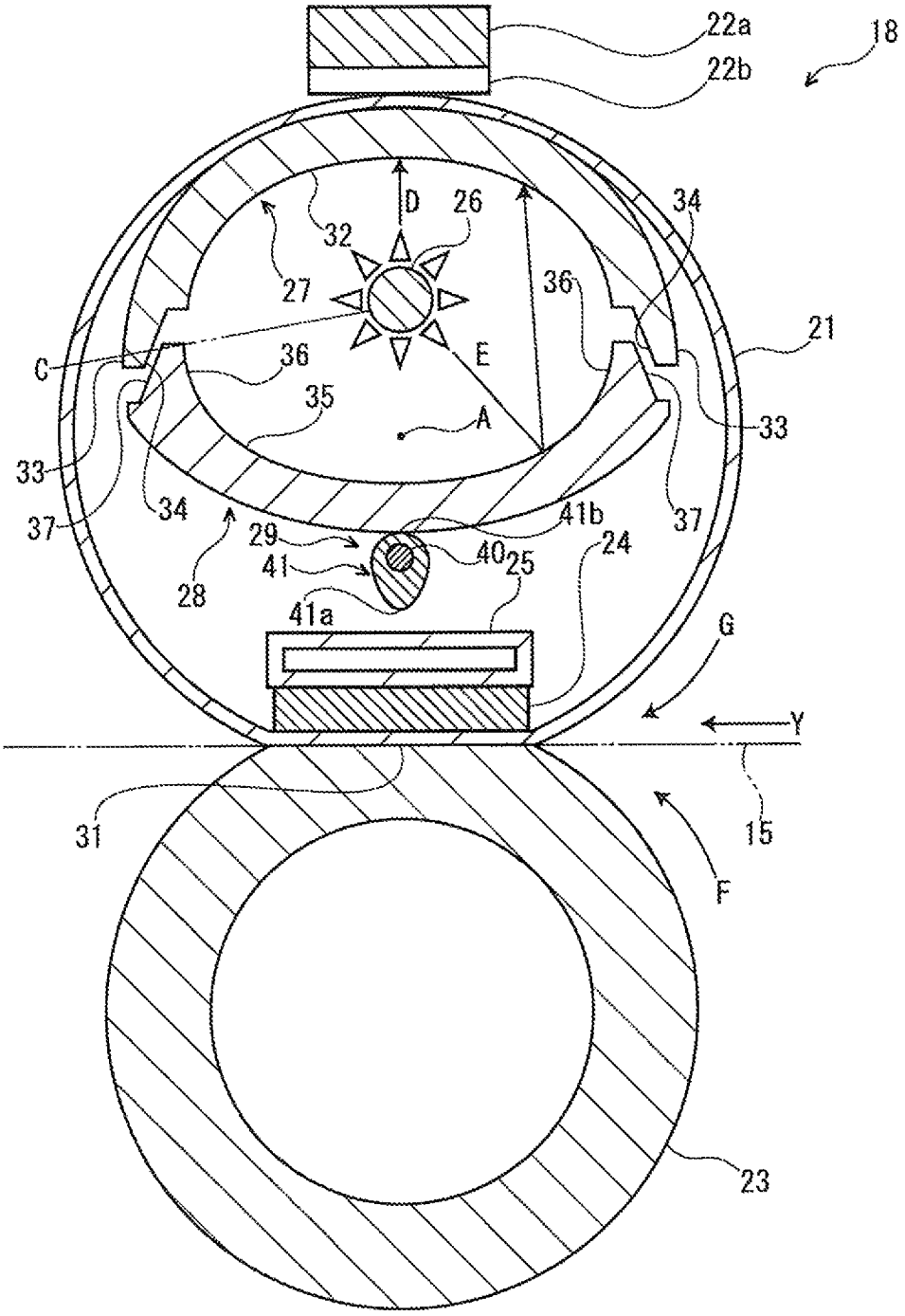
FIG. 3 is a sectional view showing the fixing device, in a condition where the first contacting part of the heat conducting member and the second contacting part of the reflecting member are separated from each other, according to the first embodiment of the present disclosure.

As shown in FIGS. 2 and 3, the fixing device 18 mainly includes a fixing belt 21 (a fixing member), thermistors 22*a* and 22*b*, a pressuring roller 23 (a pressuring member), a nip member 24, a supporting member 25, a heater 26 (a heat source), a heat conducting member 27, a reflecting member 28 and a contacting/separating mechanism 29. The thermistors 22*a* and 22*b* are arranged at an upper side (an external diameter side) of the fixing belt 21. The pressuring roller 23 is arranged at a lower side (the external diameter side) of the fixing belt 21. The nip member 24 is arranged at an internal diameter side of the fixing belt 21. The supporting member 25 is arranged at the internal diameter side of the fixing belt 21 and above the nip member 24. The heater 26 is arranged at the internal diameter side of the fixing belt 21 and above the supporting member 25. The heat conducting member 27 is arranged at the internal diameter side of the fixing belt 21 and at an upper side of the heater 26. The reflecting member 28 is arranged at the internal diameter side of the fixing belt 21 and at a lower side of the heater 26. The contacting/separating mechanism 29 is arranged at the internal diameter side of the fixing belt 21 and below the reflecting member 28. Incidentally, in FIGS. 4A and 4B, components except for the heat conducting member 27, reflecting member 28 and contacting/separating mechanism 29 are omitted.

As shown in FIGS. 2 and 3, the fixing belt 21 is formed in a roughly cylindrical shape elongated in the forward and backward directions. The fixing belt 21 has flexibility and is endless in a circumference direction. The fixing belt 21 has, for example, an external diameter of 27 mm. The fixing belt 21 is rotatably arranged around the rotating axis A extending in the forward and backward directions. That is, in the embodiment, the forward and backward directions equal to a rotating axis direction of the fixing belt 21.

The fixing belt 21 is composed of, for example, a base material layer and a release layer covering the base material layer. The base material layer of the fixing belt 21 is made of, for example, metal, such as nickel electroforming. Alternatively, the base material layer of the fixing belt 21 may be made of resin, such as polyimide (PI). The release layer of the fixing belt 21 is made of, for example, a perfluoro alkoxy alkane (PFA) tube. Incidentally, each figure shows the respective layers (the base material layer and release layer) of the fixing belt 21 without distinguishing. Onto an inner circumference face of the fixing belt 21, a fluorine-based resin coating is applied. Thereby, slidability of the fixing belt 21 with respect to the nip member 24 and heat conducting member 27 is improved.

The thermistor 22*a* (a first temperature detecting part) is a non-contact type temperature sensor capable of detecting temperature of a center part in the forward and backward directions (an image area) of the fixing belt 21. The thermistor 22*b* (a second temperature detecting part) is a contact type temperature sensor capable of detecting temperature of a front end part or a rear end part (non-image areas) of the fixing belt 21. The fixing belt 21 is controlled, on the basis of signals from the thermistors 22*a* and 22*b*, so as to be set to predetermined temperature (hereinafter, called as "fixing temperature") at which the toner image becomes fixable onto the sheet.

The pressuring roller 23 is formed in a roughly cylindrical shape elongated in the forward and backward directions. The pressuring roller 23 is composed of, for example, a cylindrical core metal, an elastic layer provided around the core metal and a release layer covering the elastic layer. The core metal of the pressuring roller 23 is made of, e.g. metal, such as iron. The core metal of the pressuring roller 23 has, for example, an external diameter of 12 mm. The elastic layer of the pressuring roller 23 is made of, for example, a silicone rubber. The elastic layer of the pressuring roller 23 has, for example, a thickness of 6.5 mm. The release layer of the pressuring roller 23 is made of, for example, a PFA tube. Incidentally, each figure shows the respective layers (the core metal, elastic layer and release layer) of the pressuring roller 23 without particularly distinguishing.

The pressuring roller 23 comes into pressure contact with the fixing belt 21 and, between the fixing belt 21 and pressuring roller 23, a fixing nip 31 is formed. The pressuring roller 23 is rotatably supported by a fixing frame (not shown). The pressuring roller 23 is connected to a drive source (not shown) composed of a motor or the like and configured to be rotated by the drive source.

The nip member 24 is formed in a plate shape elongated in the forward and backward directions. The nip member 24 is made of, for example, a heat resistant resin, such as liquid crystal polymer (LCP). A lower face of the nip member 24 presses the fixing belt 21 to the lower side (a side of the pressuring roller 23).

The supporting member 25 is formed in a shape elongated in the forward and backward directions. The supporting member 25 is formed in a hollow square shaped section. To a lower face of the supporting member 25, an upper face of the nip member 24 is fixed. Thereby, the nip member 24 is supported by the supporting member 25 and a warp (a deformation due to a fixing load) of the nip member 24 is restrained.

The heater 26 is composed of, for example, one halogen heater of 800 W. The heater 26 is configured to be energized by voltage application from a voltage supplying part (not shown) and to generate heat, and then, to emit radiant heat (radiant light).

The heat conducting member 27 is formed in a shape elongated in the forward and backward directions. The heat conducting member 27 is made of metal, such as aluminum. In an inner circumference face (a face facing to the heater 26) of the heat conducting member 27, a black coating improving heat absorptivity is applied. Both front and rear end parts of the heat conducting member 27 are held by a holding member (not shown). By such a configuration, heat transfer from the heat conducting member 27 to components except for the fixing belt 21 is restrained as little as possible.

The heat conducting member 27 has a first main body part 32 curved in an arc shape toward the upper side (a side separating from the fixing nip 31) and first extending parts 33 extending from both left and right end parts of the first main body part 32 toward the lower side (a side of the reflecting member 28). An outer circumference face of a center part in the left and right directions of the first main body part 32 comes into contact with an upper area of the inner circumference face of the fixing belt 21. In an inside face in the left and right directions of each first extending part 33, a first contacting part 34 is formed. The first contacting part 34 is inclined downwardly toward the outside in the left and right directions.

The reflecting member 28 is formed in a shape elongated in the forward and backward directions. The reflecting member 28 is made of, for example, metal, such as bright aluminum.

The reflecting member 28 has a second main body part 35 curved in an arc shape toward the lower side (a side approaching to the fixing nip 31) and second extending parts 36 extending from both left and right end parts of the second main body part 35 toward the upper side (a side of the heat conducting member 27). The second main body part 35 faces to the first main body part 32 of the heat conducting member 27 across the heater 26. In an outside face in the left and right directions of each second extending part 36, a second contacting part 37 is formed. The second contacting part 37 is inclined downwardly toward the outside in the left and right directions.

Figure 4A:
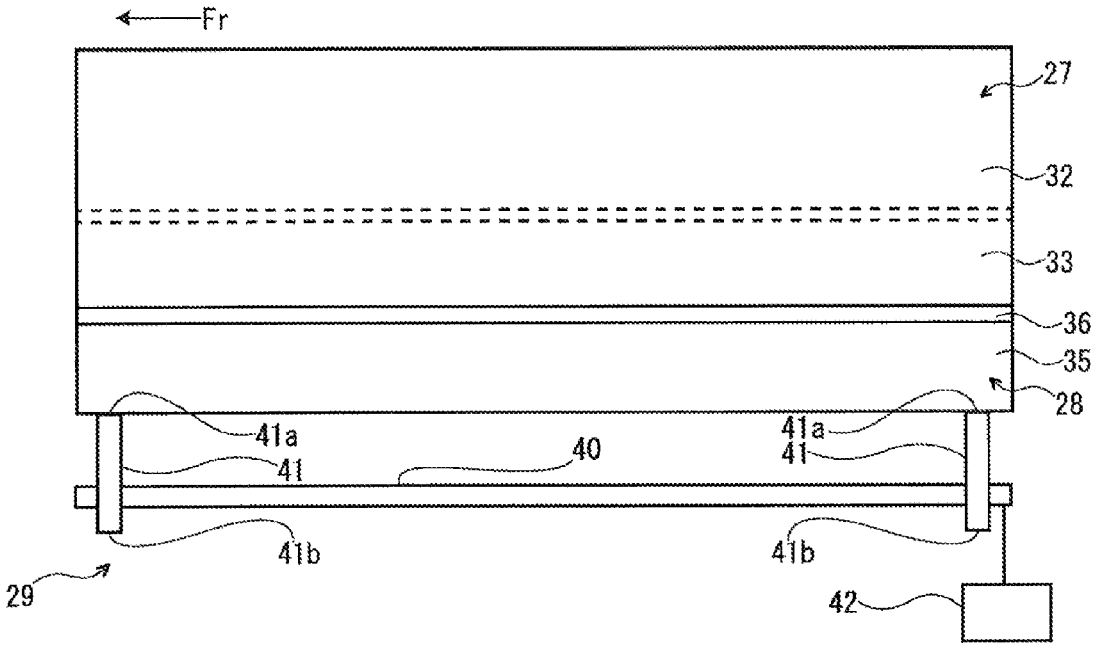
FIG. 4A is a side view showing the fixing device, in the condition where the first contacting part of the heat conducting member and the second contacting part of the reflecting member come into contact with each other, according to the first embodiment of the present disclosure.
Figure 4B:
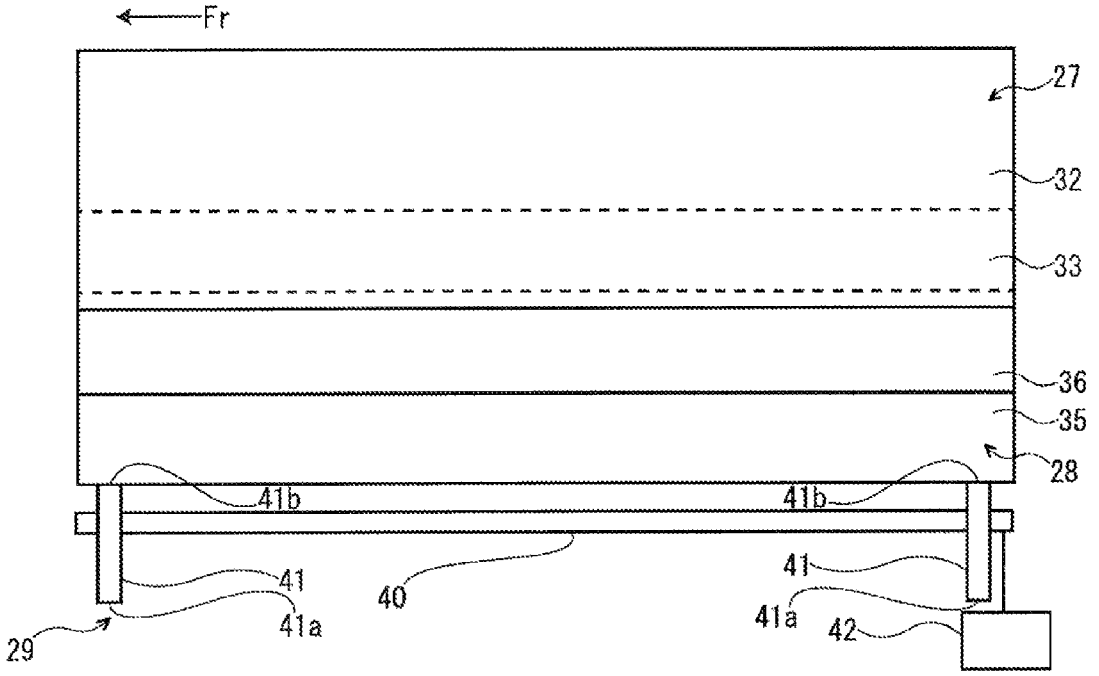
FIG. 4B is a side view showing the fixing device, in the condition where the first contacting part of the heat conducting member and the second contacting part of the reflecting member are separated from each other, according to the first embodiment of the present disclosure.

As shown in FIGS. 4A and 4B, the contacting/separating mechanism 29 includes a cam shaft 40 extending in the forward and backward directions, cam parts 41 fixed to both front and rear end parts of the cam shaft 40 and a drive source 42 connected to the cam shaft 40. As shown in FIGS. 2 and 3 and other figures, each cam part 41 has a large diameter part 41*a* and a small diameter part 41*b* formed at an opposite side to the large diameter part 41*a* across the cam shaft 40. A distance between the cam shaft 40 and large diameter part 41*a* is larger than a distance between the cam shaft 40 and small diameter part 41*b*.

In the fixing device 18 configured as mentioned above, when the printer 1 is stopping, as shown in FIGS. 2 and 4A, the large diameter part 41*a* of the cam part 41 of the contacting/separating mechanism 29 comes into contact with a lower face of the second main body part 35 of the reflecting member 28. According to this, the first contacting part 34 of the first extending part 33 of the heat conducting member 27 (hereinafter, calls as the "first contacting part 34 of the heat conducting member 27") comes into contact with the second contacting part 37 of the second extending part 36 of the reflecting member (hereinafter, calls as the "second contacting part 37 of the reflecting member 28"). At this time, the first extending part 33 of the heat conducting member 27 and the second extending part 36 of the reflecting member 28 are overlapped as viewed from the heater 26 (refer to a two-dot chain line B in FIG. 2).

Subsequently, when the power is supplied to the printer 1 and the heater 26 is energized by voltage application from the voltage supplying part (not shown), the drive source 42 of the contacting/separating mechanism 29 works to turn the cam shaft 40 by 180 degrees. When the cam shaft 40 is thus turned by 180 degrees, as shown in FIGS. 3 and 4B, each cam part 41 fixed to the cam shaft 40 is also turned by 180 degrees and the small diameter part 41*b* of each cam part 41 comes into contact with the lower face of the second main body part 35 of the reflecting member 28. According to this, the reflecting member 28 is moved downwardly by empty weight and the first contacting part 34 of the heat conducting member 27 and the second contacting part 37 of the reflecting member 28 are separated from each other. At this time, the first extending part 33 of the heat conducting member 27 and the second extending part 36 of the reflecting member 28 are overlapped as viewed from the heater 26 (refer to a two-dot chain line C in FIG. 3).

In addition, when the heater 26 is energized as mentioned above, the heater 26 generates heat and emits the radiant heat (the radiant light). The radiant heat emitted from the heater 26 to the heat conducting member 27 is directly absorbed, as indicated by an arrow D in FIG. 3, by the heat conducting member 27 and conducted from the heat conducting member 27 to the fixing belt 21. The radiant heat emitted from the heater 26 to the reflecting member 28 is reflected, as indicated by an arrow E in FIG. 3, toward the heat conducting member 27 by the reflecting member 28, absorbed by the heat conducting member 27 and conducted from the heat conducting member 27 to the fixing belt 21. By the above-mentioned action, the fixing belt 21 is heated by heat conduction from the heat conducting member 27.

Moreover, when the heater 26 is energized as mentioned above, as indicated by an arrow F in FIG. 3, the drive source (not shown) works to rotate the pressuring roller 23. When the pressuring roller 23 is thus rotated, as indicated by an arrow G in FIG. 3, the fixing belt 21 coming into pressure contact with the pressuring roller 23 is co-rotated in an opposite direction to the pressuring roller 23. By making the fixing belt 21 thus rotate, temperature non-uniformity of the fixing belt 21 is restrained.

When a predetermined time is elapsed after the energization of the heater 26 and the fixing belt 21 is heated to the fixing temperature, the fixing device 18 becomes a condition capable of fixing the toner image onto the sheet. In such a condition, when the sheet is passed through the fixing nip 31, the toner image is heated and melted, and then, the toner image is fixed onto the sheet. During the sheet is passed through the fixing nip 31, the first contacting part 34 of the heat conducting member 27 and the second contacting part 37 of the reflecting member are separated from each other. Therefore, it is possible to restrain heat transfer from the heat conducting member 27 to the reflecting member 28. According to this, it is possible to efficiently heat the fixing belt 21 and to securely fix the toner image onto the sheet.

On the other hand, after the sheet is passed through the fixing nip 31, the drive source 42 of the contacting/separating mechanism 29 works to turn the cam shaft 40 by 180 degrees. When the cam shaft 40 is thus turned by 180 degrees, as shown in FIGS. 2 and 4A, the cam part 41 fixed to the cam shaft 40 is also turned by 180 degrees and the large diameter part 41*a* of the cam part 41 comes into contact with the lower face of the second main body part 35 of the reflecting member 28. According to this, the cam part 41 presses upwardly the reflecting member 28 and the first contacting part 34 of the heat conducting member 27 comes into contact with the second contacting part 37 of the reflecting member 28 again. Therefore, it is possible to efficiently transfer heat of the fixing belt 21 to the reflecting member 28 via the heat conducting member 27. According to this, it is possible to uniformize temperature distribution in the forward and backward directions of the fixing belt 21.

As described above, the fixing device 18 of the embodiment includes the contacting/separating mechanism 29 making the heat conducting member 27 and reflecting member come into contact with/separate from each other. Therefore, when heating the fixing belt 21 by the heat conduction from the heat conducting member 27, it is possible to restrain the heat transfer from the heat conducting member 27 to the reflecting member 28 by making the heat conducting member 27 and reflecting member 28 separate from each other by the contacting/separating mechanism 29. According to this, it is possible to efficiently heat the fixing belt 21. On the other hand, when uniformizing the temperature of the fixing belt 21, it is possible to efficiently transfer the heat of the fixing belt 21 to the reflecting member 28 via the heat conducting member 27 by making the heat conducting member 27 and reflecting member 28 come into contact with each other. According to this, it is possible to solve the temperature non-uniformity of the fixing belt 21 and to uniformize the temperature of the fixing belt 21, quickly as compared with when the heat conducting member 27 and reflecting member 28 are separated from each other.

The first extending part 33 of the heat conducting member 27 and the second extending part 36 of the reflecting member 28 are arranged so as to be overlapped as viewed from the heater 26 in both contacting and separating condition of the heat conducting member 27 and reflecting member 28. By applying such a configuration, it is possible to prevent the radiant heat emitted from the heater 26 from leaking outside the heat conducting member 27 and reflecting member 28. Therefore, it is possible to retrain the radiant heat emitted from the heater 26 from directly reaching the fixing belt 21 and to prevent the fixing belt 21 from being locally heated.

The fixing device 18 of the embodiment includes the nip member 24 pressing the fixing belt 21 to the lower side (the side of the pressuring roller 23) and supporting member 25 supporting the nip member 24. By applying such a configuration, it is possible to achieve energy saving and shortening of a warm-up time.

Although, in the embodiment, a case where the cam parts 41 are fixed to both front and rear end parts of the cam shaft 40 was described, in another embodiment, one cam part 41 may be fixed to the center of the cam shaft 40. Although, in the embodiment, a case of using the contacting/separating mechanism 29 including the cam shaft 40, cam part 41 and drive source 42 was described, in another embodiment, another contacting/separating mechanism having a different configuration may be used.

In the embodiment, a case of moving the reflecting member 28 in the upward and downward directions (the direction approaching to/separating from the heat conducting member 27) was described. However, in another embodiment, the heat conducting member 27 may be moved in the upward and downward directions (the direction approaching to/separating from the reflecting member 28) or both the heat conducting member 27 and reflecting member 28 may be moved in the upward and downward directions. In a case of moving the heat conducting member 27 in the upward and downward directions, it is preferable to make the heat conducting member 27 separate from the fixing belt 21 in accordance with the movement of the heat conducting member 27 downwardly (in the approaching direction to the reflecting member 28). By making the heat conducting member 27 separate from the fixing belt 21, it is possible to quickly uniformize the temperature of the fixing belt having a small heat capacity. In addition, by making the heat conducting member 27 separate from the fixing belt 21, even if the heater 26 were to get into runaway and to become a state of always generating the heat, since heat quantity conducted from the heat conducting member 27 to the fixing belt 21 is small, it is possible to restrain the temperature of the fixing belt 21 from excessively rising and to prevent the fixing belt 21 from deteriorating.

Although, in the embodiment, a case of using the heater 26 composed of the halogen heater as the heat source was described, in another embodiment, another heater composed of a ceramic heater or the like may be used as the heat source.

Although, in the embodiment, a case of using the fixing belt 21 as the fixing member was described, in another embodiment, a fixing roller may be used as the fixing member.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

Second Embodiment

Next, a fixing device 51 according to a second embodiment of the present disclosure will be described. Arrows Fr in FIGS. 5, 7, 9 and 11A-11C indicate the front side of the fixing device 51. Arrows I and arrows O in FIGS. 5, 7, 9 and 11A-11C respectively indicate the inside and outside in forward and backward directions. Incidentally, other components except for reflecting member 52, driving mechanism 53 and contacting/separating mechanism (not shown) have similar or corresponding configurations to the first embodiment, and therefore, the other components will be denoted by the same reference numerals in the figures and their explanation will be omitted.

Figure 5:
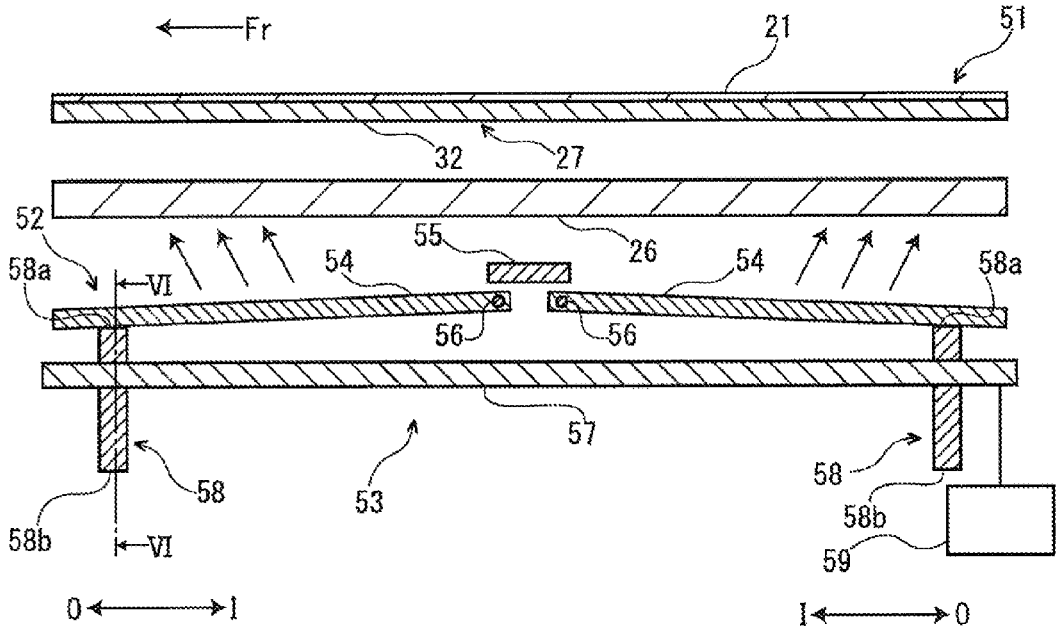
FIG. 5 is a sectional view showing a fixing device, in a condition where a swinging part of a reflecting member takes a first posture, according to a second embodiment of the present disclosure.

As shown in FIG. 5 and other figures, the reflecting member 52 is divided into a plurality of pieces in the forward and backward directions to include a pair of front and rear swinging parts 54 and a fixed part 55 located between the pair of front and rear swinging parts 54. Each swinging part 54 and the fixed part 55 are curved in an arc shape toward the lower side (refer to FIG. 6).

In an end part inside in the forward and backward directions of each swinging part 54 of the reflecting member 52, a fulcrum part 56 is arranged. Each swinging part 54 is configured to swing around the fulcrum part 56 so as to be swingable among a first posture (refer to FIGS. 5 and 11A) slightly inclined outside in the forward and backward directions, a second posture (refer to FIGS. 7 and 11B) slightly inclined inside in the forward and backward directions and a third posture (refer to FIGS. 9 and 11C) in roughly parallel to the forward and backward directions.

As shown in FIG. 5 and other figures, the driving mechanism 53 includes a cam shaft 57 extending in the forward and backward directions, cams 58 fixed to both front and rear end parts of the cam shaft 57 and a drive source 59 connected to the cam shaft 57.

Figure 6:
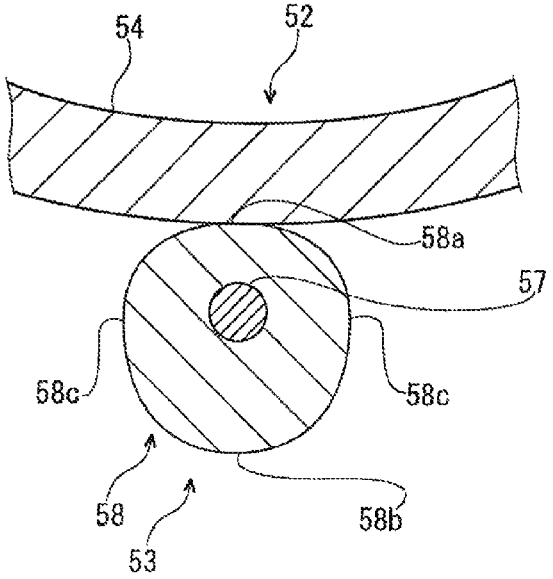
FIG. 6 is a sectional view taken along a line VI-VI of FIG. 5.

As shown in FIG. 6 and other figures, each cam 58 has a small diameter part 58*a*, a large diameter part 58*b* formed at an opposite side to the small diameter part 58*a* across the cam shaft 57 and a pair of intermediate diameter parts 58*c* formed between the small diameter part 58*a* and large diameter part 58*b*. Among distances from the cam shaft 57 to the small diameter part 58*a*, large diameter part 58*b* and intermediate diameter part 58*c*, the distance between the cam shaft 57 and small diameter part 58*a* is shortest and the distance between the cam shaft 57 and large diameter part 58*b* is longest.

The contacting/separating mechanism (not shown) is configured so as to move the heat conducting member 27 in the upward and downward directions with respect to the reflecting member 52, and accordingly, to make the heat conducting member 27 and reflecting member 52 come into contact with/separate from each other. A configuration and action of the contacting/separating mechanism (not shown) are similar to the configuration and action of the contacting/separating mechanism 29 on the first embodiment, and therefore, their explanation will be omitted.

Figure 9:
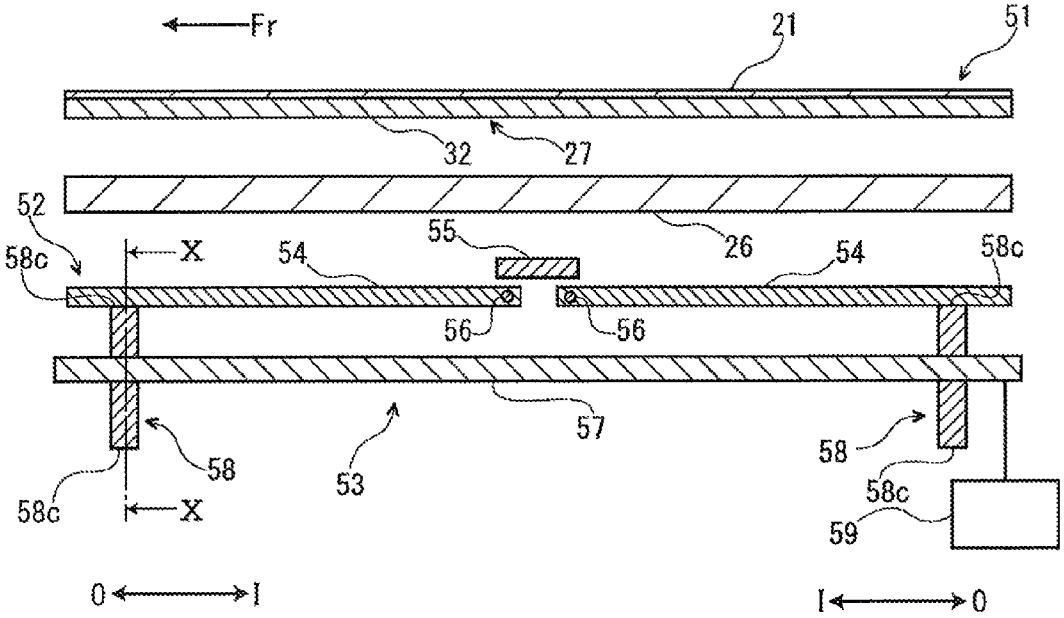
FIG. 9 is a sectional view showing the fixing device, in a condition where the swinging part of the reflecting member takes a third posture, according to the second embodiment of the present disclosure.
Figure 10:
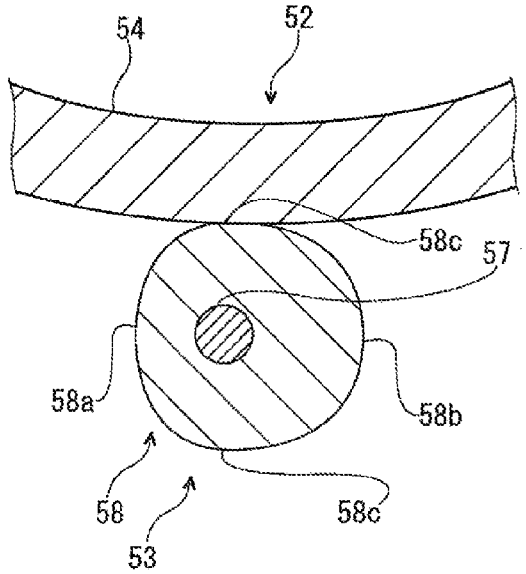
FIG. 10 is a sectional view taken along a line X-X of FIG. 9.
Figure 11A:
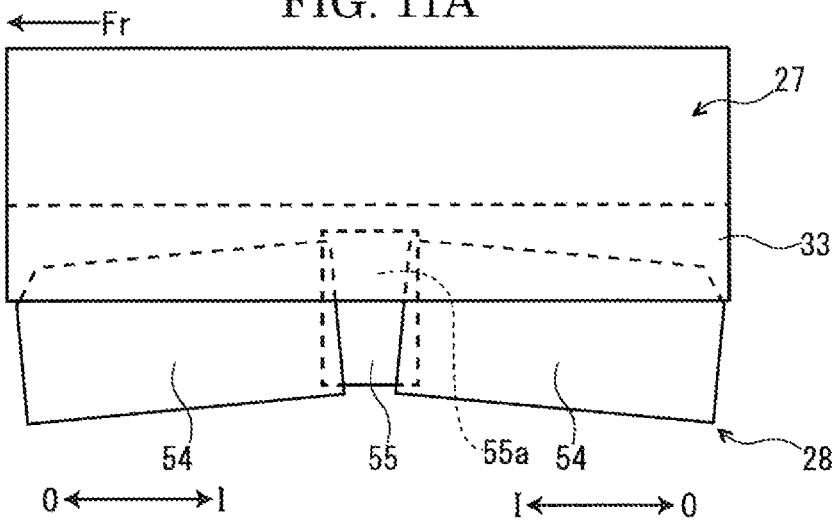
FIG. 11A is a side view showing the fixing device, in the condition where the swinging part of the reflecting member takes the first posture, according to the second embodiment of the present disclosure.
Figure 11B:
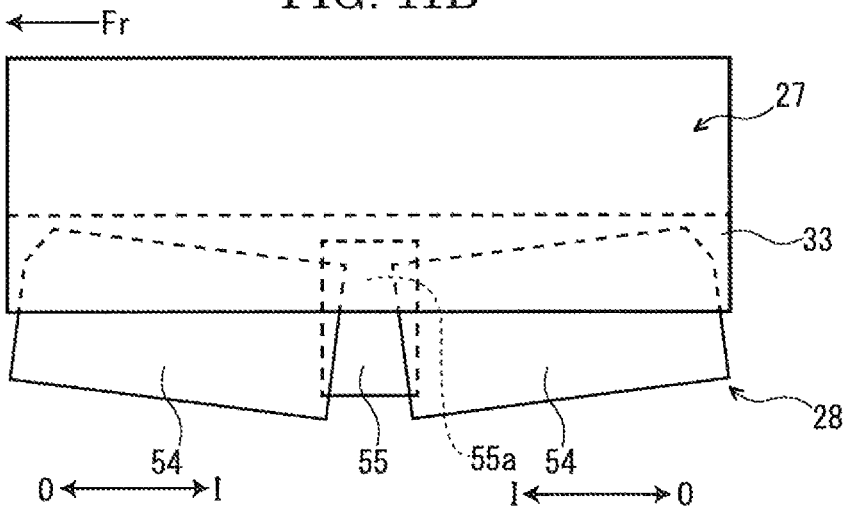
FIG. 11B is a side view showing the fixing device, in the condition where the swinging part of the reflecting member takes the second posture, according to the second embodiment of the present disclosure.
Figure 11C:
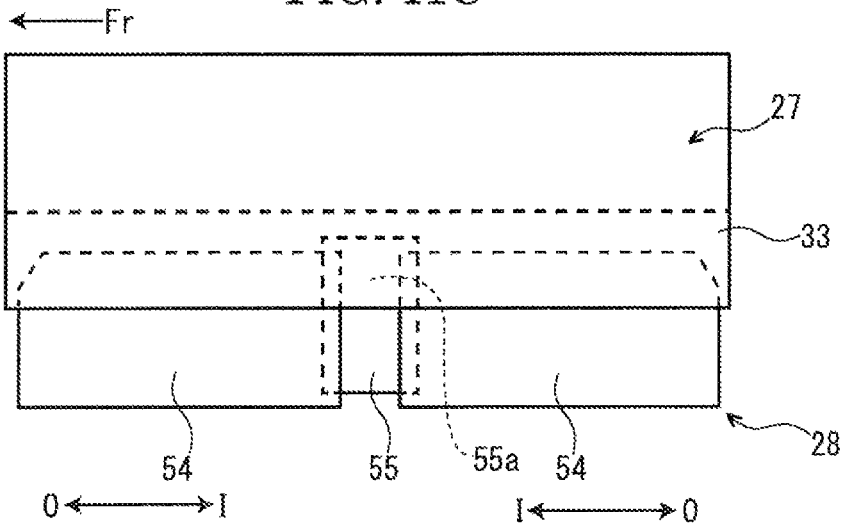
FIG. 11C is a side view showing the fixing device, in the condition where the swinging part of the reflecting member takes the third posture, according to the second embodiment of the present disclosure.

In the fixing device 51 configured as mentioned above, when the printer 1 is stopping, as shown in FIGS. 9 and 10, the intermediate diameter part 58*c* of each cam 58 comes into contact with a lower face of each swinging part 54 of the reflecting member 52. According to this, each swinging part 54 of the reflecting member 52 takes the third posture.

Subsequently, when the power is supplied to the printer 1 and the heater 26 is energized, the drive source 59 of the driving mechanism 53 works to turn the cam shaft 57. When the cam shaft 57 is thus turned, each cam 58 is also turned, and then, as shown in FIGS. 5 and 6, the small diameter part 58*a* of each cam 58 comes into contact with the lower face of each swinging part 54 of the reflecting member 52. According to this, each swinging part 54 of the reflecting member 52 is swung from the third posture to the first posture.

When the each swinging part 54 of the reflecting member 52 thus takes the first posture, the radiant heat emitted from the heater 26 is reflected toward the direction inclined outside in the forward and backward directions by each swinging part 54 (refer to FIG. 5). According to this, both front and rear end parts of the heat conducting member 27 are intensively heated and both front and rear end parts of the fixing belt 21 are intensively heated by heat conduction from both front and rear end parts of the heat conducting member 27. Just after the heater 26 is energized, in general, temperatures of both front and rear end parts of the fixing belt 21 are hard to be risen as compared with the center part in the forward and backward directions of the fixing belt 21. However, by intensively heating both front and rear end parts of the fixing belt 21 as mentioned above, it is possible to rise the temperatures of both front and rear end parts of the fixing belt 21 at the same rate as the center part in the forward and backward directions of the fixing belt 21. Therefore, it is possible to heat the fixing belt 21 uniformly and to shorten a time until the fixing belt 21 reaches to the fixing temperature.

Figure 7:
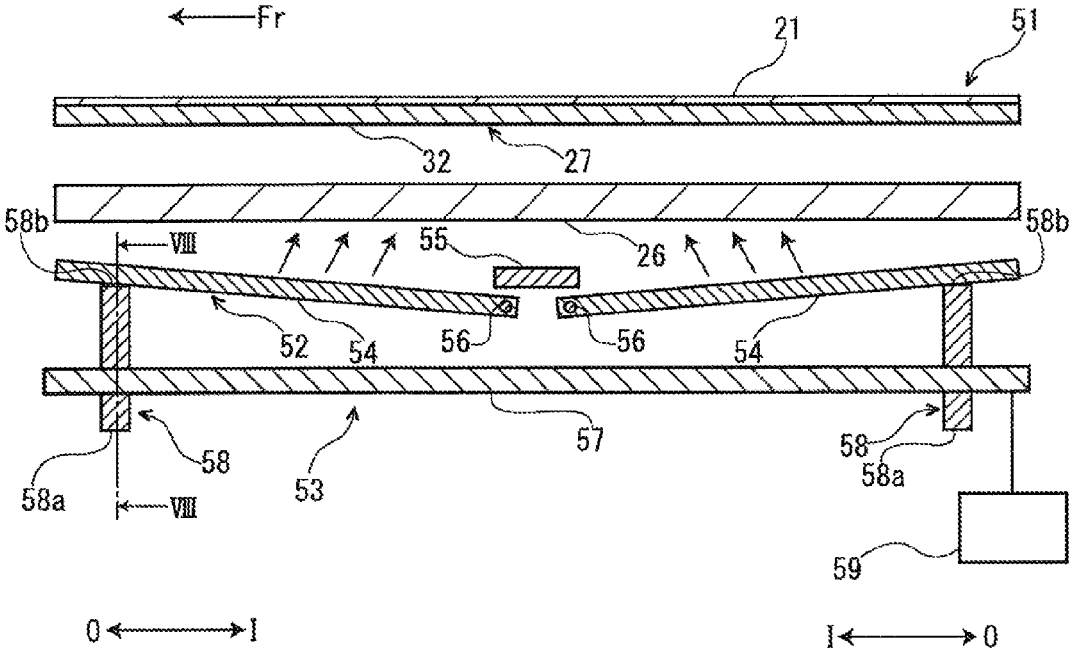
FIG. 7 is a sectional view showing the fixing device, in a condition where the swinging part of the reflecting member takes a second posture, according to the second embodiment of the present disclosure.
Figure 8:
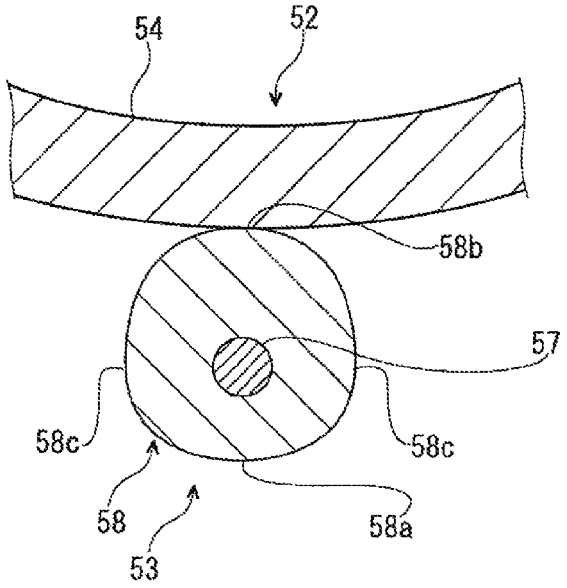
FIG. 8 is a sectional view taken along a line VIII-VIII of FIG. 7.

On the other hand, in continuous sheet passing (when the sheet continuously is passed through the fixing nip 31) or small sized sheet passing (when a small sized sheet is passed through the fixing nip 31), because the heat of the center part in the forward and backward directions of the fixing belt 21 is taken by the sheet, there is a possibility that the temperature of the center part in the forward and backward directions of the fixing belt 21 is lower than those of both front and rear end parts of the fixing belt 21. Thereupon, in the continuous sheet passing or the small sized sheet passing, the drive source 59 of the driving mechanism 53 works to turn the cam shaft 57. When the cam shaft 57 is thus turned, each cam 58 is also turned, and then, as shown in FIGS. 7 and 8, the large diameter part 58*b* of each cam 58 comes into contact with the lower face of each swinging part 54 of the reflecting member 52. According to this, each swinging part 54 of the reflecting member 52 is pressed upwardly by each cam 58 and each swinging part 54 of the reflecting member 52 is swung from the first posture to the second posture.

When the each swinging part 54 of the reflecting member 52 thus takes the second posture, the radiant heat emitted from the heater 26 is reflected toward the direction inclined inside in the forward and backward directions by each swinging part 54 of the reflecting member 52 (refer to FIG. 7). According to this, a center part in the forward and backward directions of the heat conducting member 27 is intensively heated and the center part in the forward and backward directions of the fixing belt 21 is intensively heated by heat conduction from the center part in the forward and backward directions of the heat conducting member 27. Therefore, it is possible to avoid the temperature of the center part in the forward and backward directions of the fixing belt 21 from lowering than both front and rear end parts of the fixing belt 21. Accordingly, it is unnecessary to elongate an energizating time of the heater 26 in order to rise the temperature of the center part in the forward and backward directions of the fixing belt 21, and then, it is possible to reduce power consumption.

In the embodiment, as described above, it is configured so that when each cam 58 of the driving mechanism 53 is turned, each cam 58 presses each swinging part 54 of the reflecting member 52 so that each swinging part 54 of the reflecting member 52 is swung. By applying such a configuration, it is possible to easily change an angle of the each swinging part 54 of the reflecting member 52.

Since the reflecting member 52 is divided into the plurality of pieces in the forward and backward directions, it is possible to flexibly make the reflecting member 52 come into contact with/separate from the heat conducting member 27.

Although the description in the embodiment was omitted, in another embodiment, the posture of each swinging part 54 of the reflecting member 52 may be changed on the basis of signals from the thermistors 22*a* and 22*b*. For example, in a case where the temperature of the center part in the forward and backward directions of the fixing belt 21 detected by the thermistor 22*a* is higher than a predetermined standard value or a case where the temperature of the front end part or rear end part of the fixing belt 21 detected by the thermistor 22*b* is lower than a predetermined standard value, each swinging part 54 of the reflecting member 52 is changed to the first posture to intensively heat both front and rear end parts of the fixing belt 21. Conversely, in a case where the temperature of the center part in the forward and backward directions of the fixing belt 21 detected by the thermistor 22*a* is lower than a predetermined standard value or a case where the temperature of the front end part or rear end part of the fixing belt 21 detected by the thermistor 22*b* is higher than a predetermined standard value, each swinging part 54 of the reflecting member 52 is changed to the second posture to intensively heat the center part in the forward and backward directions of the fixing belt 21. By applying such configurations, it is possible to uniformize the temperature distribution of the fixing belt 21 (heat distribution characteristics of the heater 26) by using feedback control. Therefore, it is possible to shorten a time until the fixing device 51 is restored to a condition capable of fixing the toner image onto the sheet and to achieve energy saving.

Third Embodiment

Next, a fixing device 61 according to a third embodiment of the present disclosure will be described. Arrows Fr in FIGS. 12A, 12B and 13 indicate the front side of the fixing device 61. Arrows I and arrows O in FIGS. 12A, 12B and 13 respectively indicate the inside and outside in forward and backward directions. Incidentally, other components except for reflecting member 62, driving mechanism 63 and contacting/separating mechanism (not shown) have similar or corresponding configurations to the first embodiment, and therefore, the other components will be denoted by the same reference numerals in the figures and their explanation will be omitted.

Figure 12A:
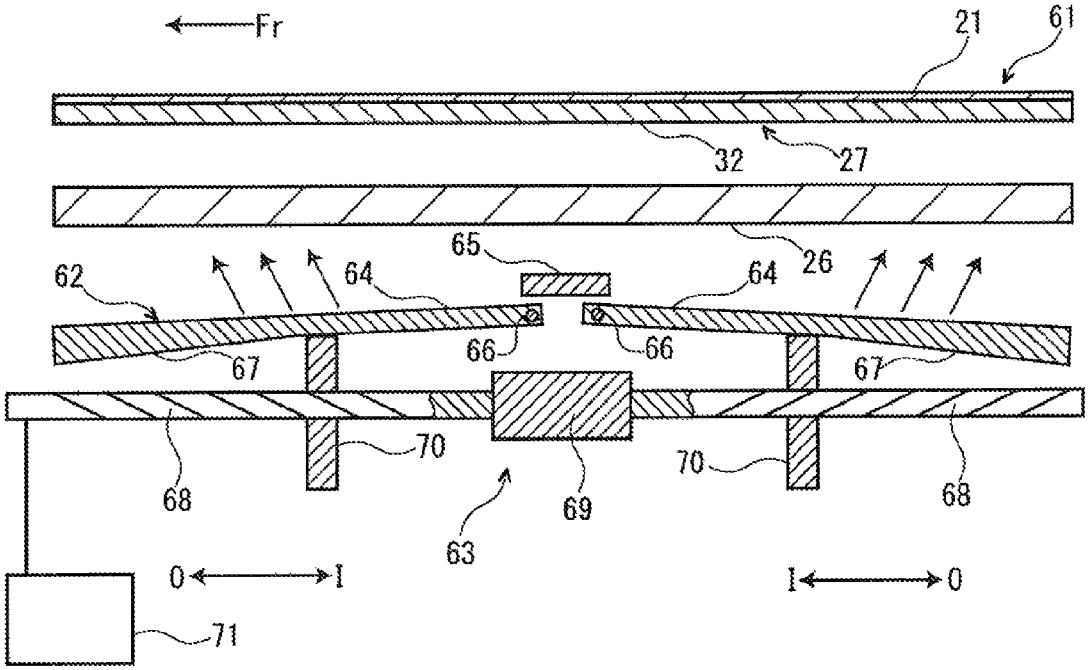
FIG. 12A is a sectional view showing a fixing device, in a condition where a swinging part of a reflecting member takes a first posture, according to a third embodiment of the present disclosure.
Figure 12B:
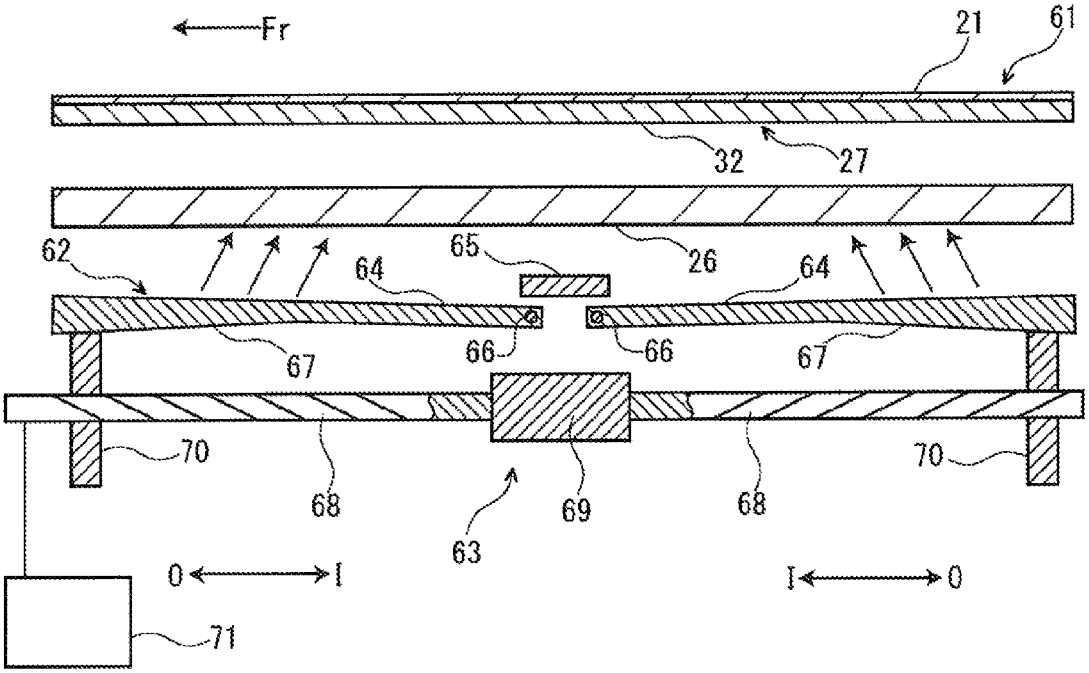
FIG. 12B is a sectional view showing the fixing device, in a condition where the swinging part of the reflecting member takes a second posture, according to the third embodiment of the present disclosure.
Figure 13:
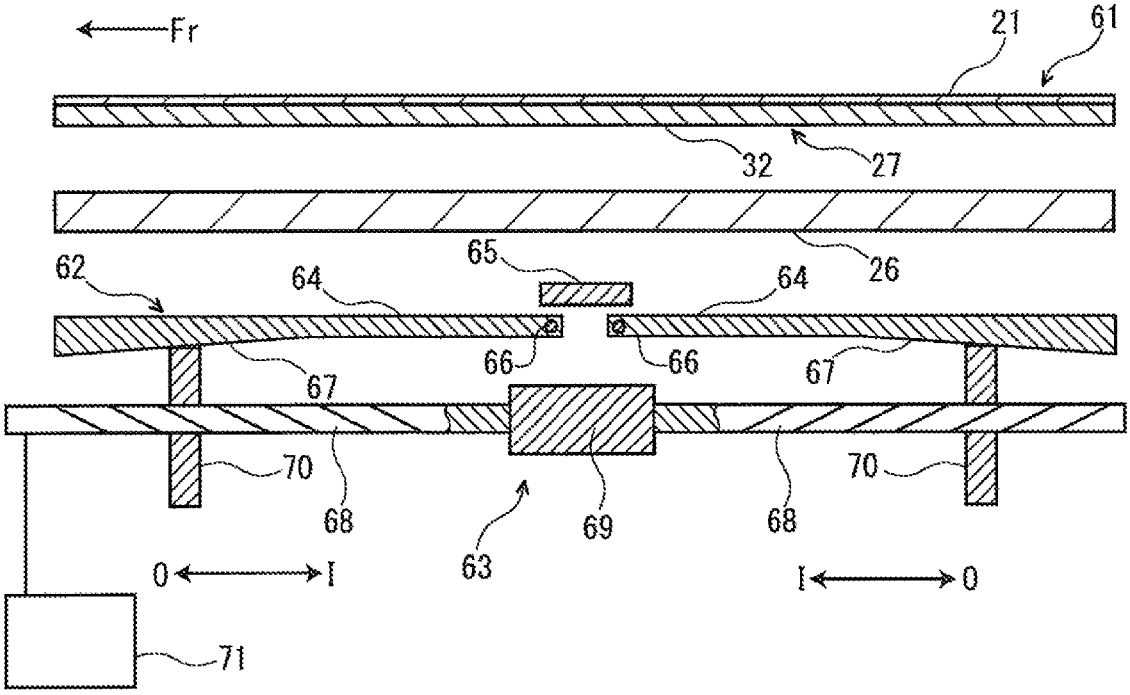
FIG. 13 is a sectional view showing the fixing device, in a condition where the swinging part of the reflecting member takes the third posture, according to the third embodiment of the present disclosure.

As shown in FIG. 12A and other figures, the reflecting member 62 includes a pair of front and rear swinging parts 64 and a fixed part 65 located between the pair of front and rear swinging parts 64.

In an end part inside in the forward and backward directions of each swinging part 64 of the reflecting member 62, a fulcrum part 66 is arranged. Each swinging part 64 is configured to swing around the fulcrum part 66 so as to be swingable among a first posture (refer to FIG. 12A) slightly inclined outside in the forward and backward directions, a second posture (refer to FIG. 12B) slightly inclined inside in the forward and backward directions and a third posture (refer to FIG. 13) in roughly parallel to the forward and backward directions. In an outside portion in the forward and backward directions of a lower face of the each swinging part 64 of the reflecting member 62, a pressed part 67 inclined with respect to the forward and backward directions (the rotating axis direction of the fixing belt 21) is formed.

The driving mechanism 63 includes a pair of screw shafts (ball screws) 68 extending in the forward and backward directions, a jointing part 69 jointing end parts inside in the forward and backward directions of the pair of screw shafts 68, pressing members 70 attached to the screw shafts 68 and a drive source 71 connected to one screw shaft 68. Each pressing member 70 is, for example, an annular member. Each pressing member 70 is screwed with each screw shaft 68 so as to be movable in the forward and backward directions (the rotating axis direction of the fixing belt 21) on each screw shaft 68 in accordance with turning of each screw shaft 68. The drive source 71 is, for example, composed of a stepping motor.

The contacting/separating mechanism (not shown) is configured so as to move the heat conducting member 27 in the upward and downward directions with respect to the reflecting member 62, and accordingly, to make the heat conducting member 27 and reflecting member 62 come into contact with/separate from each other. A configuration and action of the contacting/separating mechanism (not shown) are similar to the configuration and action of the contacting/separating mechanism 29 on the first embodiment, and therefore, their explanation will be omitted.

In the fixing device 51 configured as mentioned above, when the drive source 71 of the driving mechanism 63 works to turn each screw shaft 68 and the jointing part 69 under a condition where each swinging part 64 of the reflecting member 62 takes the first posture (refer to FIG. 12A), each pressing member 70 is moved to the outside in the forward and backward directions and each pressing member 70 press the pressed part 67 of each swinging part 64 of the reflecting member 62. According to this, each swinging part 64 is swung from the first posture (refer to FIG. 12A) to the second posture (refer to FIG. 12B) or the third posture (refer to FIG. 13). By applying such a configuration, it is possible to easily change an angle of the each swinging part 64 of the reflecting member 62.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing member arranged rotatably;

a pressuring member arranged at an external diameter side of the fixing member to come into pressure contact with the fixing member so as to form a fixing nip, and arranged rotatably;

a heat source arranged at an internal diameter side of the fixing member to emit radiant heat;

a heat conducting member coming into contact with an inner circumference face of the fixing member to absorb the radiant heat emitted from the heat source and to conduct it to the fixing member;

a reflecting member reflecting the radiant heat emitted from the heat source toward the heat conducting member; and a contacting/separating mechanism making the heat conducting member and reflecting member come into contact with or separate from each other, wherein the heat conducting member includes:

a first main body part coming into contact with the inner circumference face of the fixing member; and first extending parts extending from both end parts of the first main body part toward a side of the reflecting member, the reflecting member includes:

a second main body part facing to the first main body part across the heat source; and second extending parts extending from both end parts of the second main body part toward a side of the heat conducting member, the first extending part and second extending part are arranged so as to be overlapped as viewed from the heat source in both contacting and separating condition of the heat conducting member and reflecting member.

2. The fixing device according to claim 1, further comprising:

a nip member pressing a fixing belt as the fixing member to a side of the pressuring member; and a supporting member supporting the nip member.

3. The fixing device according to claim 1, further comprising:

a first temperature detecting part capable of detecting temperature of an image area of the fixing member; and a second temperature detecting part capable of detecting temperature of a non-image area of the fixing member.

4. The fixing device according to claim 3, wherein the first temperature detecting part is a non-contact type temperature sensor, the second temperature detecting part is a contact type temperature sensor.

5. An image forming apparatus comprising:

the fixing device according to claim 1.

6. A fixing device comprising:

a fixing member arranged rotatably;

a pressuring member arranged at an external diameter side of the fixing member to come into pressure contact with the fixing member so as to form a fixing nip, and arranged rotatably;

a heat source arranged at an internal diameter side of the fixing member to emit radiant heat;

a heat conducting member coming into contact with an inner circumference face of the fixing member to absorb the radiant heat emitted from the heat source and to conduct it to the fixing member;

a reflecting member reflecting the radiant heat emitted from the heat source toward the heat conducting member; and a contacting/separating mechanism making the heat conducting member and reflecting member come into contact with or separate from each other, wherein the contacting/separating mechanism makes the heat conducting member and reflecting member separate from each other while a recording medium is passed through the fixing nip and makes the heat conducting member and reflecting member come into contact with each other after the recording medium is passed through the fixing nip.

7. A fixing device comprising:

a fixing member arranged rotatably;

a pressuring member arranged at an external diameter side of the fixing member to come into pressure contact with the fixing member so as to form a fixing nip, and arranged rotatably;

a heat source arranged at an internal diameter side of the fixing member to emit radiant heat;

a heat conducting member coming into contact with an inner circumference face of the fixing member to absorb the radiant heat emitted from the heat source and to conduct it to the fixing member;

a reflecting member reflecting the radiant heat emitted from the heat source toward the heat conducting member; and a contacting/separating mechanism making the heat conducting member and reflecting member come into contact with or separate from each other, wherein the fixing member arranged rotatably around an rotating axis, the reflecting member includes a swinging part swingable among a first posture to reflect the radiant heat emitted from the heat source toward the direction inclined outside in the rotating axis direction and a second posture to reflect the radiant heat emitted from the heat source toward the direction inclined inside in the rotating axis direction, the fixing device further comprising a pressing member arranged movable in the rotating axis direction, wherein the swinging part includes a pressed part inclined with respect to the rotating axis direction, the pressing member presses the pressed part so that the swinging part is swung, when the pressing member is moved in the rotating axis direction.

8. A fixing device comprising:

a fixing member arranged rotatably;

a pressuring member arranged at an external diameter side of the fixing member to come into pressure contact with the fixing member so as to form a fixing nip, and arranged rotatably;

a heat source arranged at an internal diameter side of the fixing member to emit radiant heat;

a heat conducting member coming into contact with an inner circumference face of the fixing member to absorb the radiant heat emitted from the heat source and to conduct it to the fixing member;

a reflecting member reflecting the radiant heat emitted from the heat source toward the heat conducting member; and a contacting/separating mechanism making the heat conducting member and reflecting member come into contact with or separate from each other, wherein the contacting/separating mechanism includes:

a cam shaft;

a cam part fixed to the cam shaft; and a drive source connected to the cam shaft.

* * * * *